United States Patent [19]

Shinoda et al.

[11] Patent Number: 4,984,539

[45] Date of Patent: Jan. 15, 1991

[54] LIQUID COOLED INTERNAL COMBUSTION ENGINE

[75] Inventors: Akihisa Shinoda; Motohiro Fujita; Haruo Tsusaka; Makoto Yonezawa; hiroyuki Nakano, all of Saitama, Japan

[73] Assignee: Honda Giken Kogyo Kabushiki Kaisha, Japan

[21] Appl. No.: 514,594

[22] Filed: Apr. 26, 1990

[30] Foreign Application Priority Data

May 15, 1989 [JP] Japan ..... 1-55531[U]
May 15, 1989 [JP] Japan ..... 1-55532[U]
May 15, 1989 [JP] Japan ..... 1-121169
May 15, 1989 [JP] Japan ..... 1-121170

[51] Int. Cl.[5] ..... F01P 3/00

[52] U.S. Cl. ..... 123/41.42; 123/41.43; 123/41.72; 123/90.27; 123/196 W

[58] Field of Search ..... 123/41.42, 41.43, 41.47, 123/41.72, 90.27, 90.34, 196 W, 195 R, 195 HC

[56] References Cited

U.S. PATENT DOCUMENTS 2,478,106 8/1949 Jozif ..... 123/90.27
4,688,529 8/1987 Mitadera et al. ..... 123/195 HC
4,790,273 12/1988 Oguri et al. ..... 123/41.42
4,920,927 5/1990 Tsusaka et al. ..... 123/41.42

FOREIGN PATENT DOCUMENTS 5837920 5/1956 Japan .
1151709 6/1989 Japan .

*Primary Examiner*—Noah P. Kamen
*Attorney, Agent, or Firm*—Eckert Seamans Cherin & Mellott

[57] ABSTRACT

A liquid cooled internal combustion engine, comprising: an integrally cast engine main body including a cylinder block, a cylinder head, and a crankcase skirt, a crankcase cover attached to an open end of the skirt to define a crankcase therein, a crankshaft extending vertically in the crankcase and rotatably supported by the skirt at its both ends, a camshaft rotatably supported by the cylinder head and extending in parallel with the crankshaft, a timing belt passed around pulleys mounted on lower ends of the camshaft and the crankshaft, respectively, and extending in a belt chamber defined in the cylinder block along a lower side of the cylinder bore; a cooling liquid jacket defined in the cylinder block along upper and lateral sides of the cylinder bore. The jacket may be formed during the casting process by pulling a core either upwards or toward the open end of the skirt. The cooling liquid may consist of the lubricating oil for the engine. Thus, a jacket for the cooling liquid can be formed without requiring its cylinder head to be cast separately from its cylinder block, and the rigidity of the part of the cylinder block adjoining its cylinder head can be increased without increasing its wall thickness. Also, a compact design of the engine is made possible, and the process of fabricating the engine can be simplified.

11 Claims, 14 Drawing Sheets

LIQUID COOLED INTERNAL COMBUSTION ENGINE

TECHNICAL FIELD

The present invention relates to a liquid cooled internal combustion engine defining a jacket for circulating cooling liquid around its cylinder, and in particular to such an internal combustion engine which advantageously utilizes its lubricating oil for cooling the engine.

BACKGROUND OF THE INVENTION

In a liquid cooled engine, a jacket is defined around each of its cylinders for circulating cooling liquid therein. In a normal internal combustion engine using a cylinder block and a cylinder head which are separately cast by metallic dies, it is customary to use inner cores which may be pulled out of the cylinder block from its interface with the cylinder head along a cylinder longitudinal line. In such an engine, the part of the cylinder defining a combustion chamber in cooperation with the cylinder head is known to reach a highest temperature level, and is therefore subjected to most severe thermal stresses.

In the case of a cylinder block having an annular opening around each of its cylinders at its interface with the cylinder head, it is necessary to increase the wall thickness of such a region in order to achieve a necessary rigidity of the part of the cylinder block defining the combustion chamber when the piston is near its top dead center. At the same time, not only the interface of the cylinder block with its cylinder head is required to be finished with a high precision but also the cylinder head and the cylinder block must be assembled together with a high precision to prevent leakage of cooling liquid into the combustion chamber. All these factors contributed to the increase in the cost of internal combustion engines.

Also, most liquid cooled engines are provided with radiators to remove heat from the cooling liquid, and the need for such a radiator prevented the use of a liquid cooling system in small engines due to economical considerations and space restrictions. Japanese patent laid open publication No. 1-151709 discloses a flywheel in which a heat exchange passage is defined for removing heat from the cooling liquid. Japanese utility model laid open publication No. 58-37920 discloses an internal combustion engine in which its lubricating oil is circulated in its jacket to achieve a favorable cooling effect and increase the capacity of its oil sump without increasing the size of its oil pan.

However, these prior art engines are intended for normal engines having a horizontal crankshaft, and cannot be directly applied to vertical crankshaft engines. Furthermore, they are not suitable for application to small engines due to their complex oil passage structure and jacket structure, respectively.

BRIEF SUMMARY OF THE INVENTION

In view of such problems of the prior art, a primary object of the present invention is to provide a liquid cooled vertical crankshaft internal combustion engine which allows a liquid jacket to be formed around its cylinder block in a simple manner without risking undesirable reduction in the rigidity of the part of its cylinder block defining a combustion chamber when its piston is near its top dead center.

A second object of the present invention is to provide a liquid cooled vertical crankshaft internal combustion engine which can ensure a favorable cooling effect with minimum space requirements.

A third object of the present invention is to provide a liquid cooled vertical crankshaft internal combustion engine which is easy and economical to manufacture.

These and other objects of the present invention can be accomplished by providing a liquid cooled internal combustion engine, comprising: an integrally cast engine main body including a cylinder block defining a cylinder bore extending laterally therein, a cylinder head disposed at a longitudinal end of the cylinder block, and a skirt extending from the other longitudinal end of the cylinder block; a crankcase cover attached to an open end of the skirt to define a crankcase therein; a crankshaft extending vertically in the crankcase and rotatably supported by the skirt at its both ends; a piston slidably received in the cylinder bore to define a combustion chamber in cooperation with the cylinder head and the cylinder bore and coupled to a crank pin of the crankshaft via a connecting rod; a camshaft rotatably supported by the cylinder head and extending in parallel with the crankshaft; a timing belt passed around pulleys mounted on lower ends of the camshaft and the crankshaft, respectively, and extending in a belt chamber defined in the cylinder block along a lower side of the cylinder bore; a cooling liquid jacket defined in the cylinder block along upper and lateral sides of the cylinder bore; and cooling liquid supply means for circulating cooling liquid in the jacket and removing heat from the cooling liquid.

Thus, a jacket for the cooling liquid can be formed without requiring its cylinder head to be cast separately from its cylinder block, and the rigidity of the part of the cylinder block adjoining its cylinder head can be increased without increasing its wall thickness. Further, leakage of the cooling liquid can be positively prevented. Also, a compact design of the engine is made possible, and the process of fabricating the engine can be simplified.

In particular, by using the lubricating oil of the engine as the cooling liquid, the system for circulating cooling liquid can be simplified in structure. Additionally, even when there were leakage from the cooling liquid circulating system, the possibility of causing any serious damage to the engine would be much reduced as compared with the case of liquid cooled internal combustion engines using water and similar liquids for its cooling liquid.

Such a jacket for receiving cooling liquid can be simply formed by a cavity formed by a core pulled towards the open end of the skirt or, alternatively, by a core pulled upwards from an upper side of the cylinder block during a casting process, and a cover plate closing an open end of the cavity.

To achieve a favorable heat transmission between the cylinder bore and the cooling liquid, the bottom surface of a part of the jacket may be provided with longitudinal ribs and/or lateral ribs extending along an upper side of the cylinder bore. A particularly favorable heat transfer can be accomplished when a bottom surface of a part of the jacket is provided with a plurality of lateral ribs extending along an upper side of the cylinder bore, and the cover plate is provided with a plurality of lateral ribs on its inner surface so as to interdigitate with the lateral ribs on the bottom surface of the jacket and defined a tortuous passage for the cooling liquid.

According to a preferred embodiment of the present invention, the cooling liquid supply means comprises an oil pump disposed in a lower part of the cylinder block near a lower end of the crankshaft to draw lubricating oil from a bottom area of the belt chamber, an oil supply passage extending from an outlet end of the oil pump to the jacket through a bore defined in the crankshaft, an oil return passage extending from the jacket to the belt chamber via a valve mechanism incorporated in the cylinder head. The oil pump may be driven by a balancer shaft rotatably supported by the skirt in parallel with the crankshaft. As a heat radiator to promote removal of heat from the cooling liquid, an upper end of the crankshaft may coaxially carry a disk member which internally defines a heat exchange passage interposed between the bore in the crankshaft and the jacket as a part of the oil supply passage.

The lubricating oil introduced into the cooling liquid jacket may be all led to the valve actuating mechanism incorporated in the cylinder head, but may also be partly diverted directly into the belt chamber via openings provided in low parts of the jacket to promote circulation of the cooling liquid.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
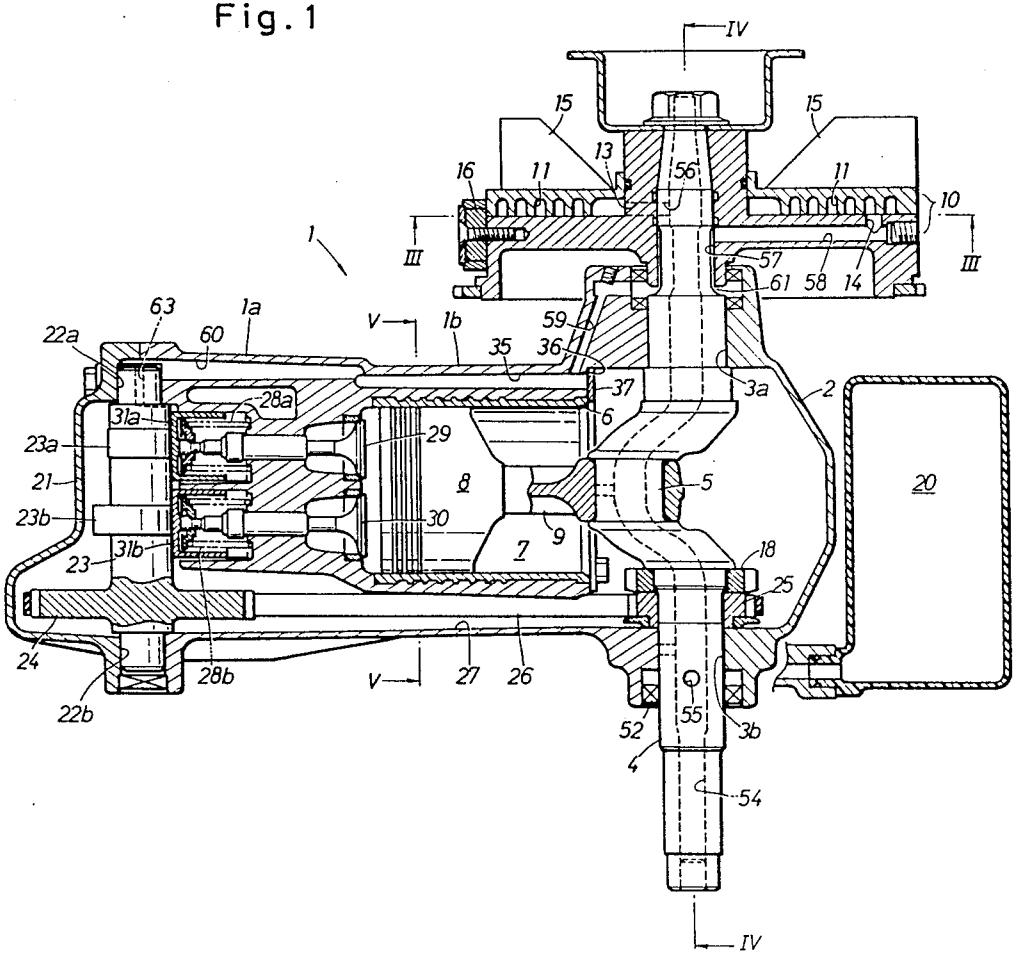
FIG. 1 is a longitudinal sectional view of a first embodiment of the liquid cooled internal combustion engine according to the present invention.
Figure 2:
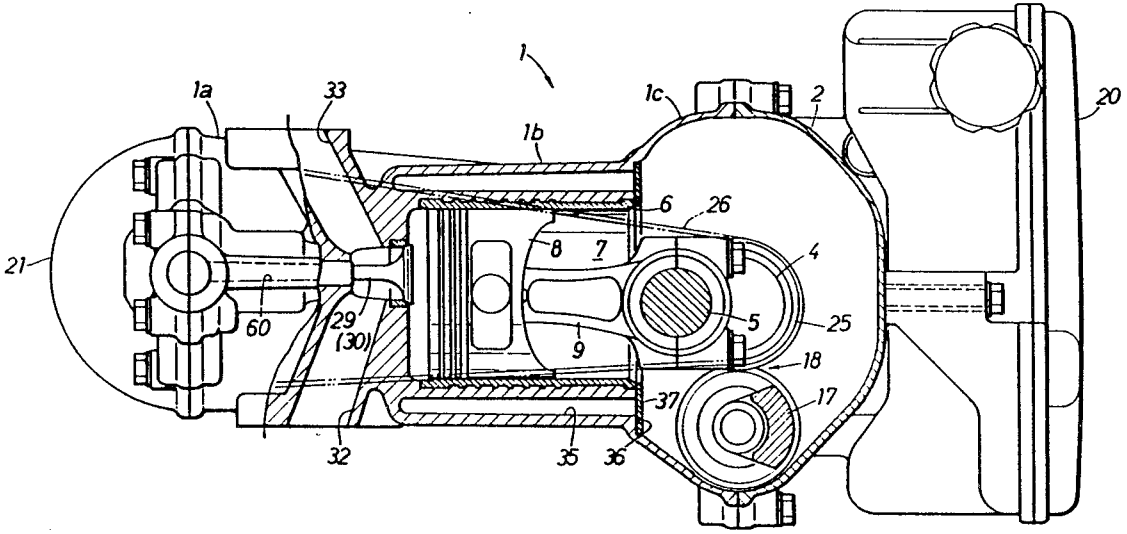
FIG. 2 is a partly broken away plan view of the first embodiment.

FIGS. 1 and 2 show a first embodiment of the liquid cooled internal combustion engine constructed as an oil-cooled, single cylinder, vertical-crankshaft engine. This engine 1 is provided with an integral engine main body including a cylinder head 1*a*, a cylinder block 1*b*, and a crankcase skirt 1*c* formed by an integral metallic die casting process.

A crankcase cover 2 is attached to the open end of the skirt 1*c*, and a crankshaft 4 is rotatably supported by a pair of slide journal bearings 3*a* and 3*b* interposed between the crankcase cover 2 and the skirt 1*c*. A piston 8 slidably received in a cylinder bore 7 defined by a cylinder liner 6 integrally cast in the cylinder block 1*b* is connected to a crank pin 5 centrally formed in the crankshaft 4 by way of a connecting rod 9.

Figure 3:
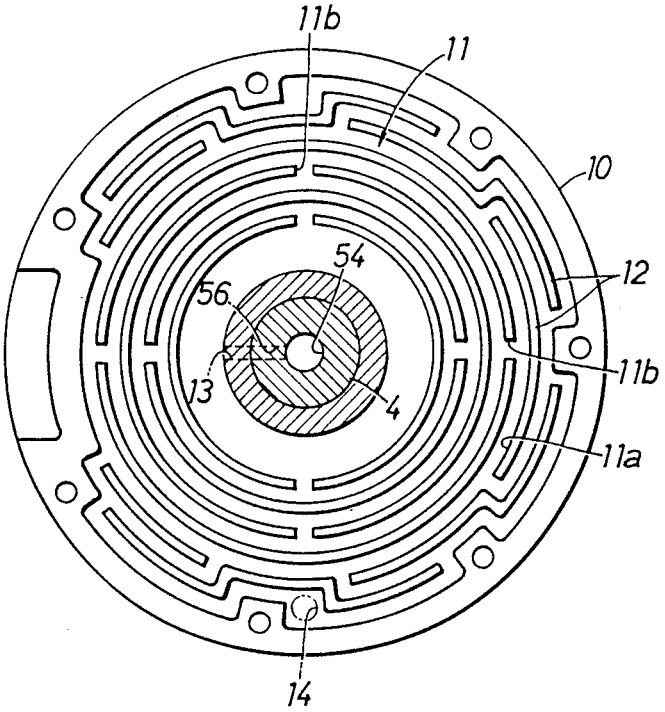
FIG. 3 is a sectional view taken along line III—III of FIG. 1.

The upper end of the crankshaft 4 is securely connected to a flywheel 10 which consists of a pair of disks defining a heat exchange passage 11 at their interface. This heat exchange passage 11 is formed as a maze consisting of a circumferential passages 11*a* defined by circumferential walls 12, and radial passages 11*b* crossing the circumferential walls 12 at selected parts as best shown in FIG. 3. And, its inlet 13 and outlet 14 are defined at a radially inner end and a radially outer end of the heat exchange passage 11, respectively.

The axial outer end or upper end of the flywheel 10 is integrally provided with heat radiation fins 15 for the purpose of cooling the cooling liquid circulating in the heat exchange passage 11. Further, a permanent magnet piece 16 is securely attached to a peripheral part of the flywheel 10 so that it may form a magneto in cooperation with an ignition unit (not shown in the drawings) securely attached to the cylinder block and produce ignition sparks at appropriate timing.

Figure 4:
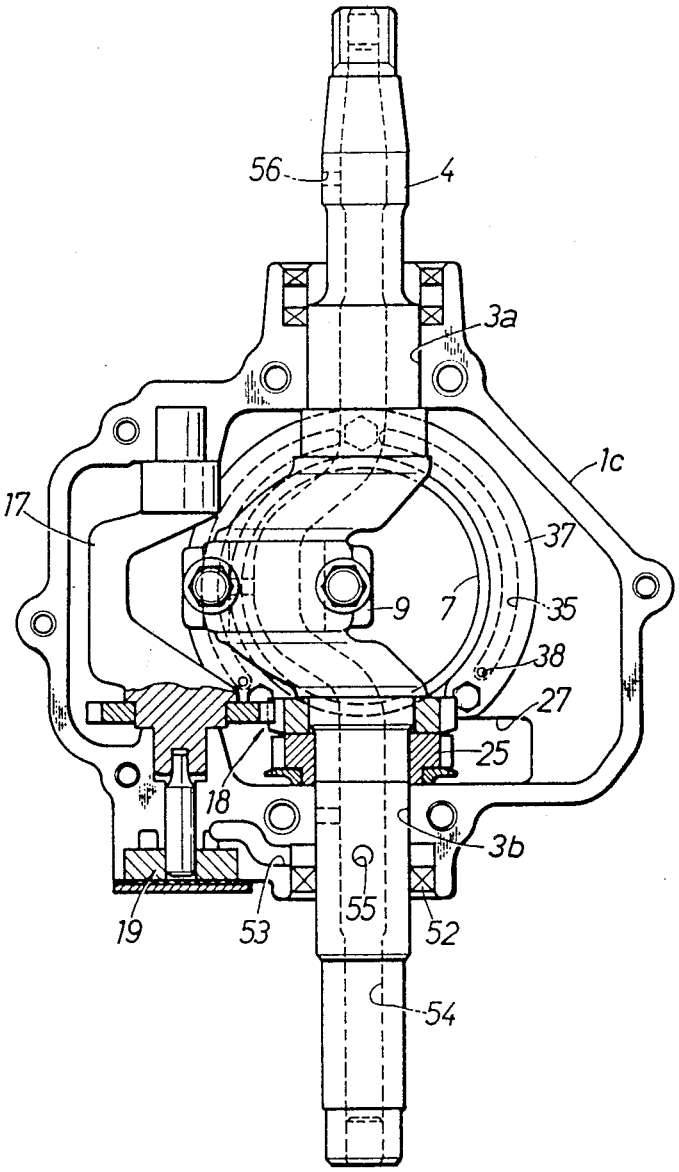
FIG. 4 is a sectional view taken along line IV—IV of FIG. 1.
Figure 6:
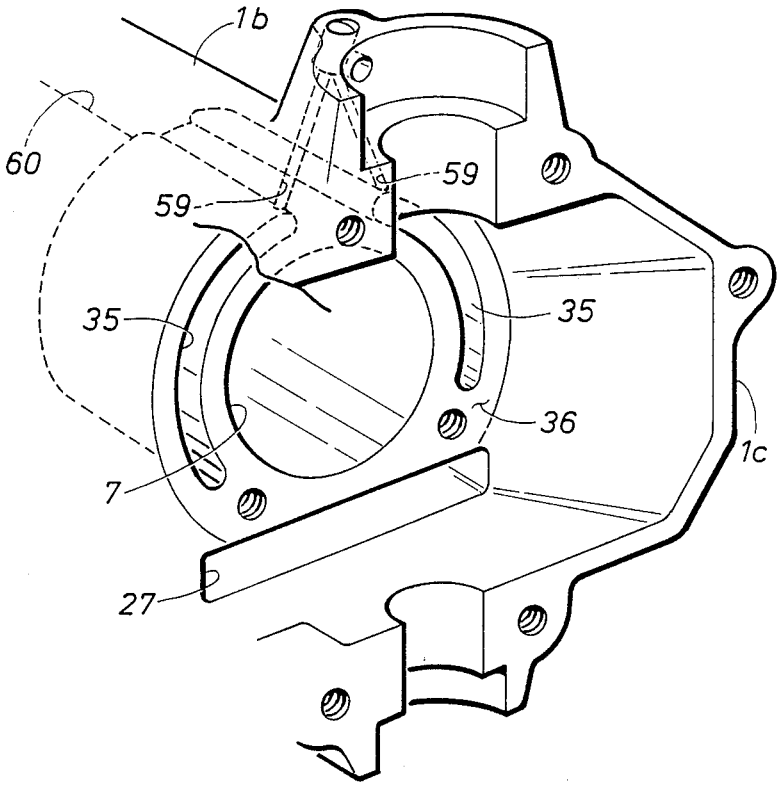
FIG. 6 is a schematic perspective view showing the details of the jacket defined in the cylinder block; cover
Figure 7:
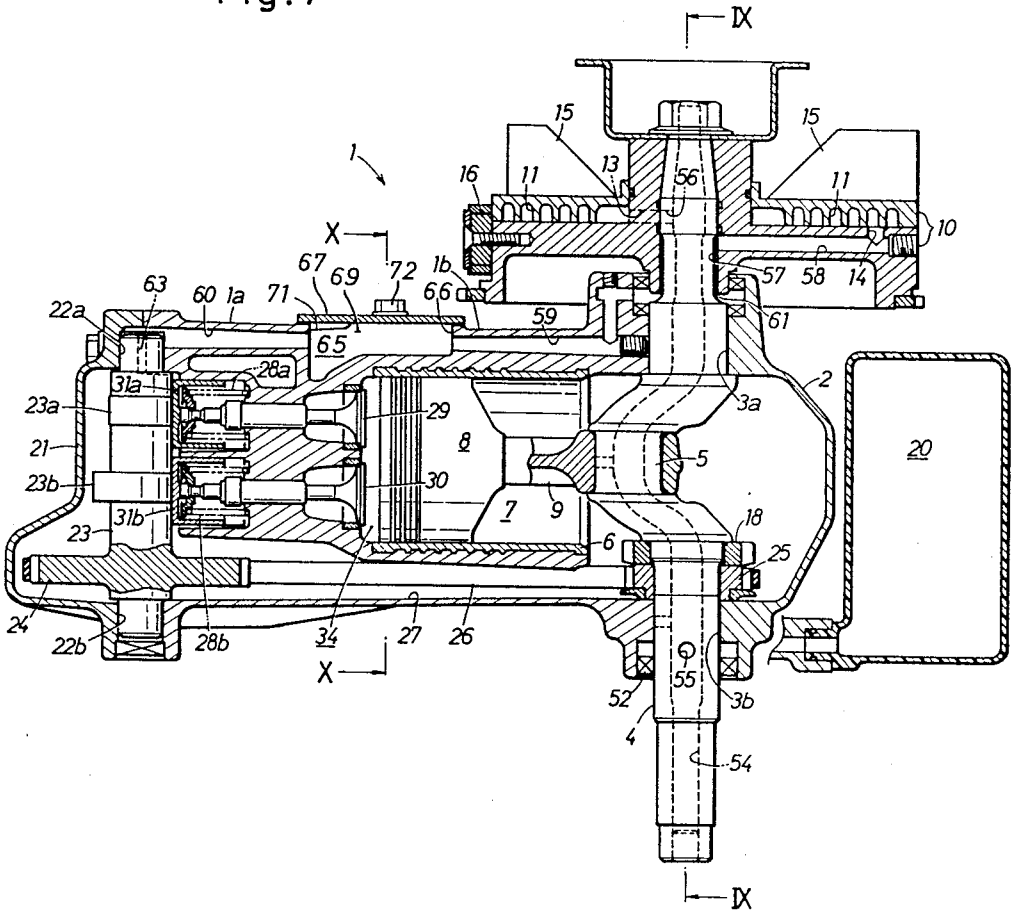
FIG. 7 is a longitudinal sectional view of a second embodiment of the liquid cooled internal combustion engine according to the present invention.
Figure 8:
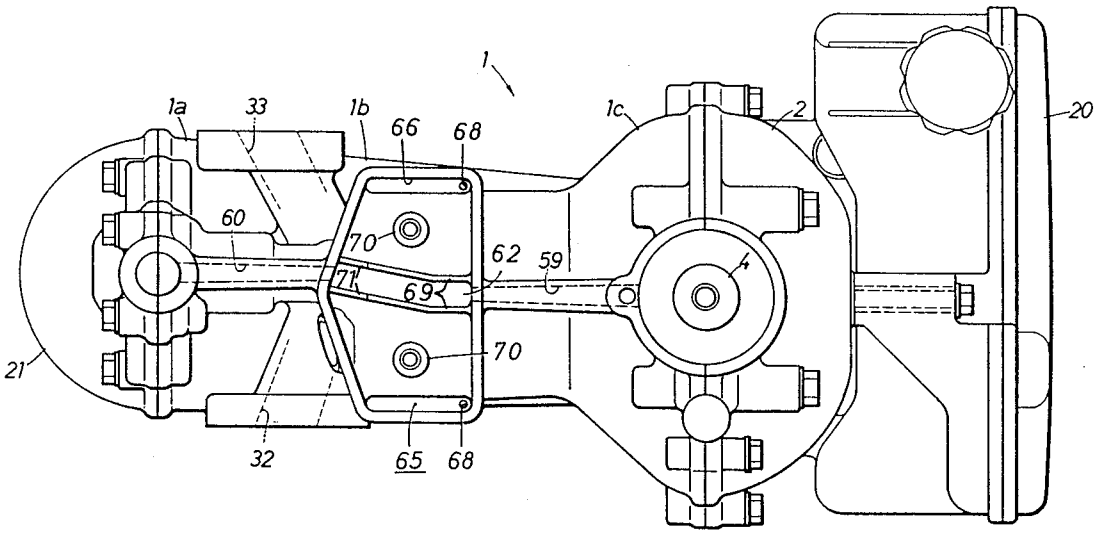
FIG. 8 is a plan view of the second embodiment with the cover plate of the jacket removed.
Figure 9:
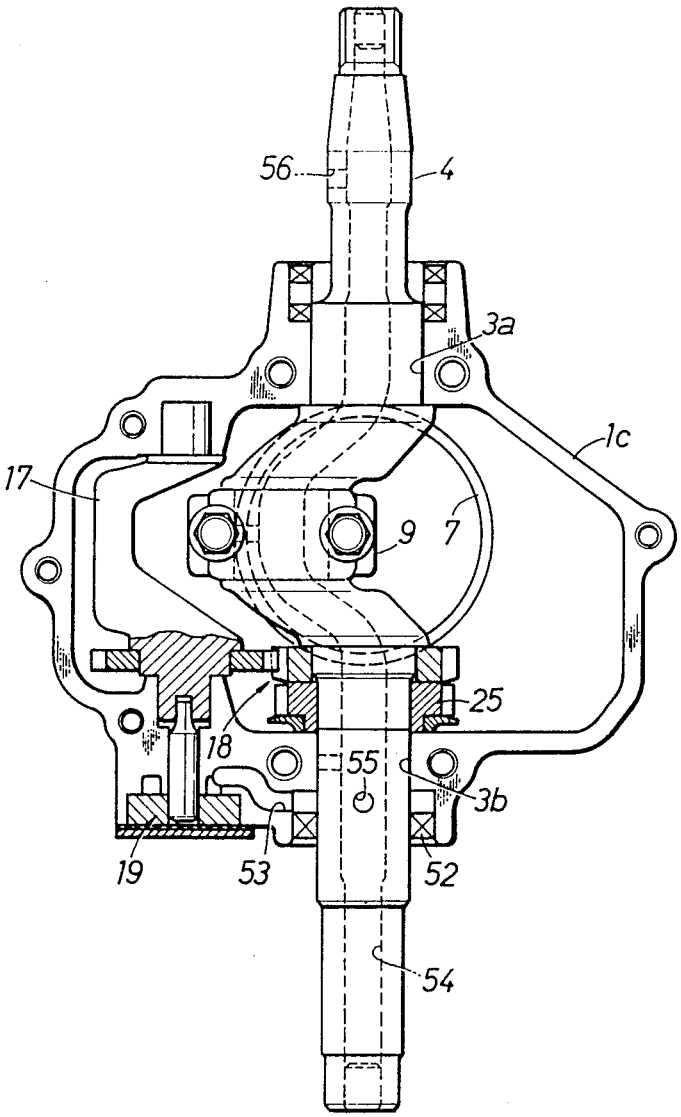
FIG. 9 is a sectional view taken along line IX—IX of FIG. 7.

A balancer shaft 17 is also rotatably supported between the skirt 1*c* and the crankcase cover 2 in parallel with the crankshaft 4 as shown in FIG. 4. This balancer shaft 17 is coupled with the crankshaft 4 via a gear train 18 so as to rotate at the same speed as but in opposite direction to the crankshaft 4 to cancel the primary unbalanced force arising from the eccentricity of the crank pin 5. One end or a lower end of the balancer shaft 17 is connected to a known volumetric pump 19 which draws lubricating oil from a lubricating oil tank 20 disposed to the right of the crankcase cover 2 and sends it to various parts of the engine under pressure as described in more detail hereinafter.

A head cover 21 is secured to the open end or the left end of the cylinder head 1*a* by threaded bolts. A pair of slide journal bearings 22*a* and 22*b* are defined in upper and lower parts of the interface between the cylinder head 1*a* and the head cover 21 to support either end of a camshaft 23 extending in parallel with the crankshaft 4. This camshaft 23 is driven at half the rotational speed of the crankshaft 4 by way of a cam pulley 24 secured to a lower end of the camshaft 23, a crank pulley 25 secured to the crankshaft 4, and a timing belt 26 passed around them. This timing belt 26 is accommodated in a belt chamber 27 extending between the interior of the crankcase cover 2 and the interior of the head cover 21 along the lower side of the cylinder bore 7 defined in the cylinder block 1*b*.

The cylinder head 1*a* is provided with an intake valve 29 and an exhaust valve 30 which are urged to their closed positions by valve springs 28*a* and 28*b*, respectively. These valves 29 and 30 are situated in a plane parallel to the crankshaft 4 at a suitable interval, and are engaged by a pair of cams 23*a* and 23*b* formed on the camshaft 23 via direct lifers 31*a* and 31*b*, respectively, so that they may be opened and closed at appropriate timing in synchronism with the rotation of the crankshaft 4.

An intake port 32 is opened on one side of the cylinder head 1*a* (the lower side thereof as seen in FIG. 2), and an exhaust port 33 is opened on the other side of the cylinder head 1*a* (the upper side thereof as seen in FIG. 2). The open end of the intake port 32 is directly connected to a carburettor (not shown in the drawings), and the open end of the exhaust port 33 is directly connected to a muffler (not shown in the drawings).

Figure 5:
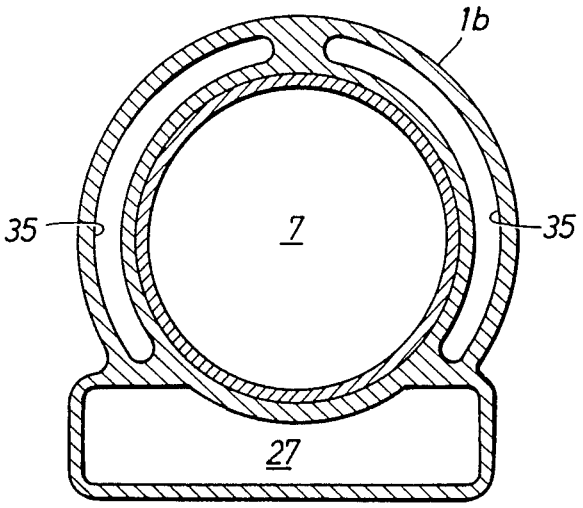
FIG. 5 is a sectional view taken along line V—V of FIG. 1.

A cooling liquid jacket 35 is defined in the cylinder block 1*a* along the upper and lateral sides of the cylinder bore 7 as shown in FIG. 5, and this jacket 35 consists of a cavity formed by a core forming a part of the set of dies used for casting this cylinder block and pulled out of the jacket 35 from inside the skirt 1*c* to the right as seen in FIG. 1 along the longitudinal axial line of the cylinder. The open end 36 of this jacket 35 facing the interior of the skirt 1*c* is closed by a cover plate 37 having the shape of a horseshoe. The bottom portions of the jacket 35 near the cover plate 37 are provided with small holes 38 for communicating the jacket 35 with the belt chamber 27 (refer to FIGS. 4 and 5).

Now the arrangement of the passages for lubricating oil of this internal combustion is described in the following with reference to FIGS. 1 and 4.

The lubricating oil circulation system of this internal combustion engine comprises a first passage 53 communicating an annular cavity defined around the lower journal of the crankshaft 4 by an annular oil seal 52 with an outlet end of the oil pump 53 (refer to FIG. 4), a crankshaft passage 54 extending axially through the crankshaft 4, a first communication port 55 provided in the crankshaft 4 to communicate the crankshaft passage 54 with the first passage 53, a second communication port 56 provided in a part of the crankshaft 4 fitted into the flywheel 10 to communicate the upper end of the crankshaft passage 54 with the inlet end 13 of the heat exchange passage 11 defined in the flywheel 10, a second passage 58 extending between the outlet end 14 of the heat exchange passage 11 to a central bore of the flywheel 10 communicating with an annular chamber 61 defined around the crankshaft 4 by an annular extension of the flywheel 10 and an annular oil seal provided in a main body part of the engine, a third passage 59 extending from the annular chamber 61 to the interior of the jacket 35, and a fourth passage 60 extending from a cylinder head end of the jacket 35 to the upper camshaft bearing 22*a*.

Now the flow of lubricating oil is described in the following.

The lubricating oil expelled from the pump 19 flows into the crankshaft passage 54 by way of the first passage 53 and the first port 55. At the same time, the lubricating oil is also supplied to the lower crankshaft journal bearing 3*b*. The crankshaft passage 54 also opens out at the crank pin 5, and lubricating oil is thereby supplied to the gap between the crank pin 5 and the big end of the connecting rod 9.

The lubricating oil which has reached an upper end of the crankshaft passage 54 is introduced into the heat exchange passage 11 in the flywheel 10 from the second port 56 to be cooled therein, and is supplied to the annular chamber 61 between the bore 57 of the flywheel 10 receiving the crankshaft 4 and the part of the crankshaft 4 adjoining the upper crankshaft bearing 3*a* as well as the third passage 59 before it is finally supplied to the jacket 35. The lubricating oil then cools the parts surrounding the cylinder bore 7, and is then supplied to the valve actuating mechanism by way of the fourth passage 60, a passage 63 defined in a part of the camshaft 23 supported by the upper camshaft bearing 22*a*, and the interior of the head cover 21. The lubricating oil also cools the lower part of the cylinder as it returns to the interior of the crankcase cover 2 via the belt chamber 27.

The cooling liquid flows into the crankcase cover 2 also from the small holes 38 of the cover plate 37, and further into the tank 20. In this way, it is possible to adjust the overall flow rate of the lubricating oil serving as a cooling liquid by varying the relative flow rates through the fourth passage 60 and the small holes 38.

Although the jacket was formed by a casting process using metallic dies, it is also possible to use a sand casting process. In this case, since there is no need to open out the part of the cylinder block facing the interior of the crankcase cover 2 as opposed to the metallic die casting process, it is possible to eliminate the need for the cover plate 37.

FIGS. 7 through 11 show a second embodiment of the present invention. In these embodiments, like parts are denoted with like numerals.

According to this embodiment, a jacket 65 is defined by a cavity formed in the cylinder block 1*b* by a core which is pulled out upwards or, in other words, radially away from the cylinder bore 7, and its upper open end 66 is closed by a cover plate 67 and threaded bolts 69 securing the cover plate 67 to the cylinder block 1*b*. This jacket 65 extends on either lateral side of the cylinder bore 7, and is provided with a pair of openings 68 in its bottom regions which communicate with the belt chamber 27 (refer to FIG. 10).

Figure 10:
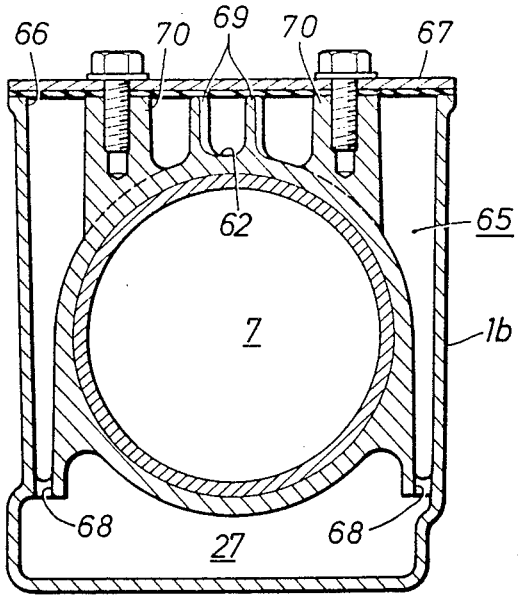
FIG. 10 is a sectional view taken along line X—X of FIG. 7.
Figure 11:
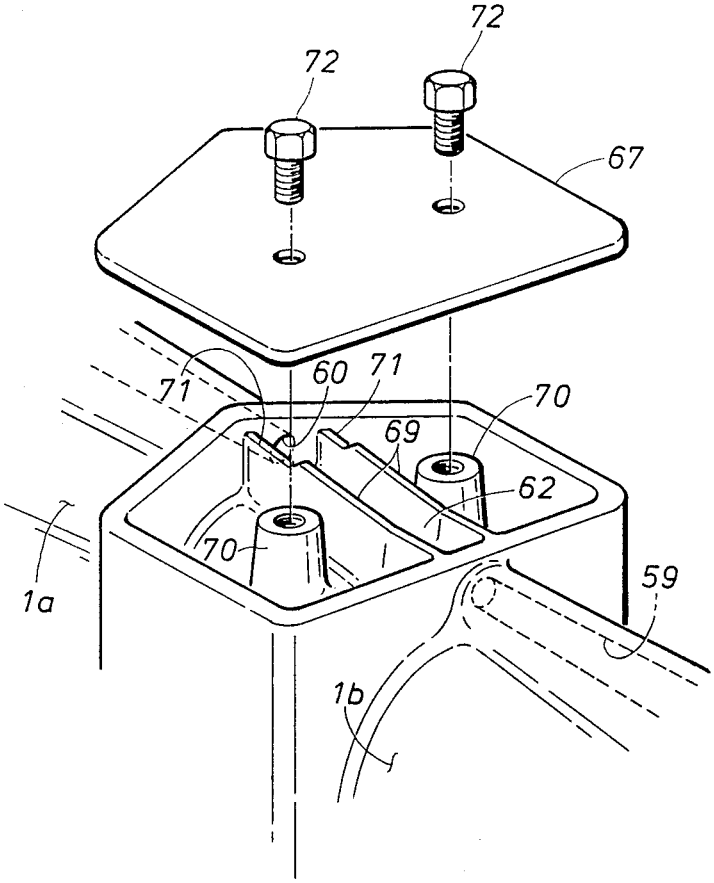
FIG. 11 is an exploded perspective view of a part of the second embodiment.
Figure 12:
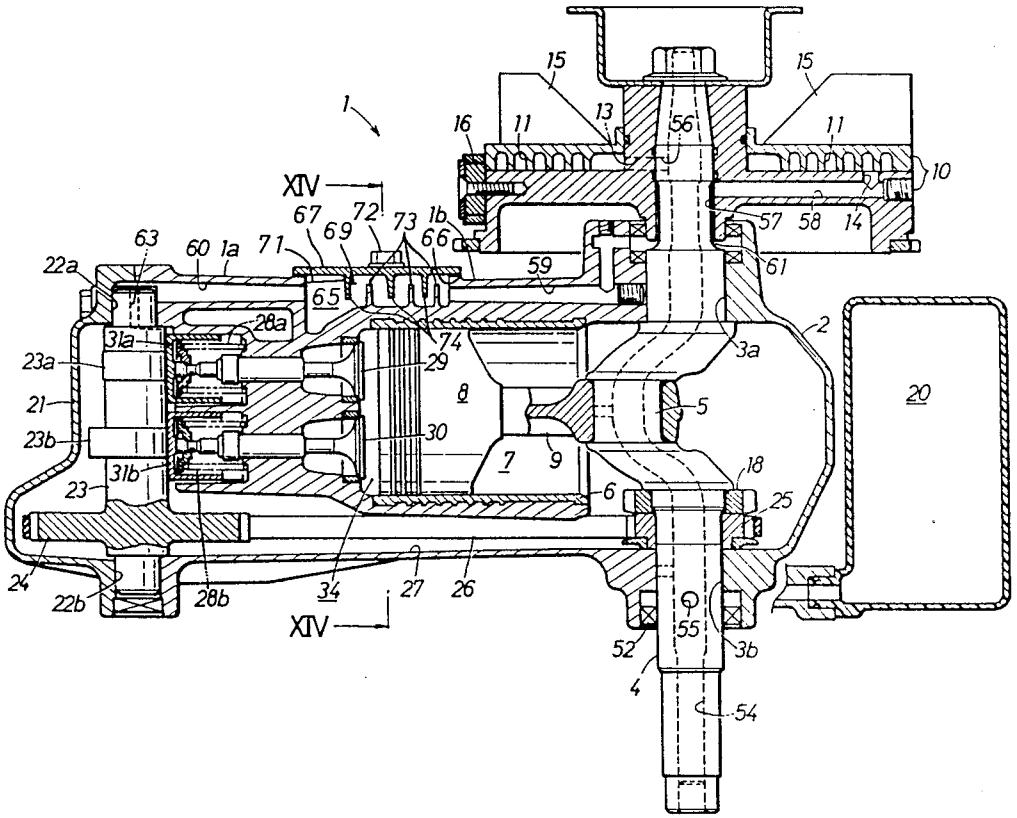
FIG. 12 is a longitudinal sectional view of a third embodiment of the liquid cooled internal combustion engine according to the present invention.
Figure 13:
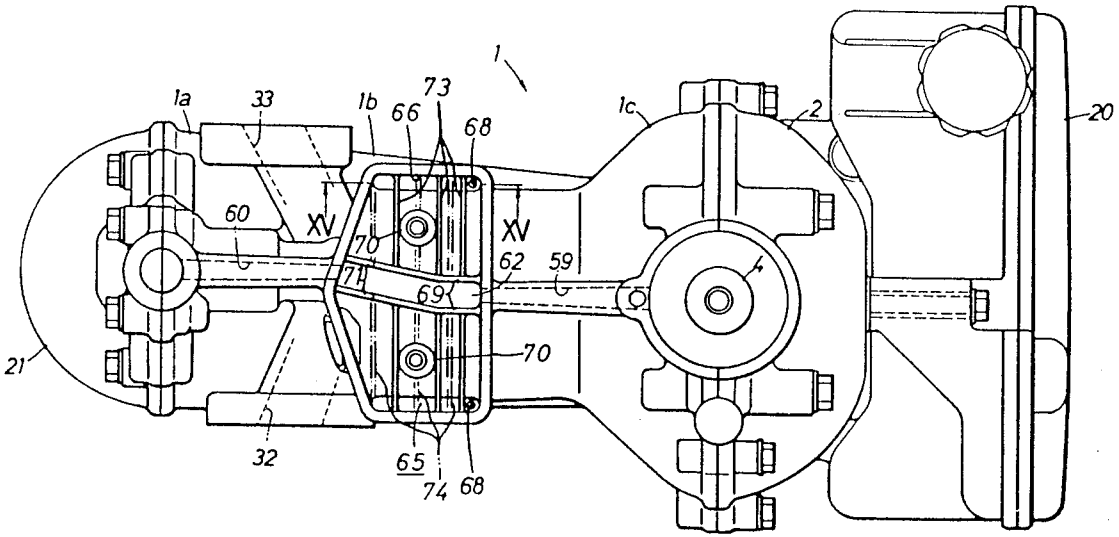
FIG. 13 is a plan view of the third embodiment with the cover plate of the jacket removed.
Figure 14:
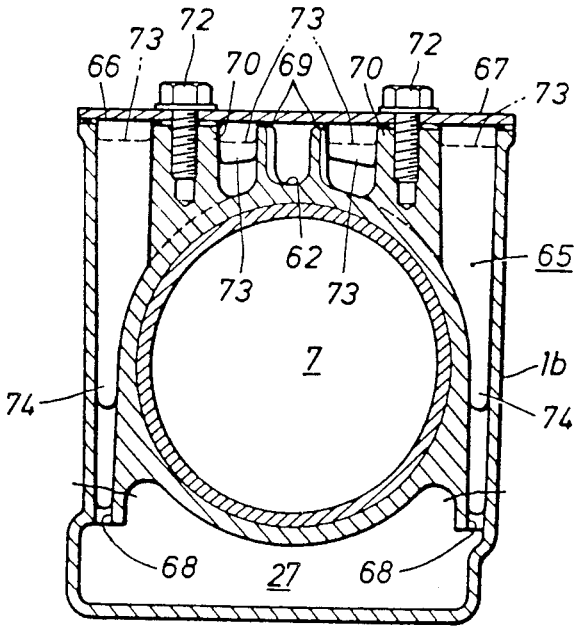
FIG. 14 is a sectional view taken along line XIV—XIV of FIG. 12.
Figure 15:
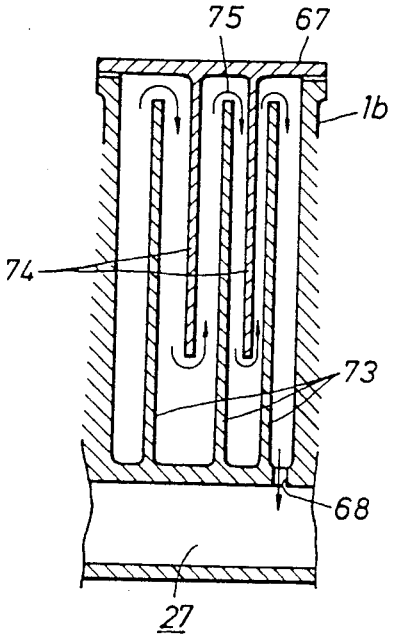
FIG. 15 is a sectional view taken along line XV—XV of FIG. 12.

As best shown in FIGS. 10 and 11, the central bottom region of the jacket 65 corresponding to the upper side of the cylinder bore 7 is provided with a pair of longitudinal ribs 69, and a pair of bosses 70 having threaded holes for receiving the threaded bolts 67. These ribs 69 and bosses 70 are formed, along with the jacket 65, simultaneously as casting the cylinder block 1*b*. Each of the ribs 69 is provided with a notch 71 at its end adjoining the cylinder head 1*a*.

According to this embodiment, the lubricating oil received in the lubricating oil tank 20 is fed by the pump 19 into the crankshaft passage 54 via the first passage 53 and the first communication port 55, and is then flows into the heat exchange passage 11 defined in the flywheel 10 via the second communication port 56 and the inlet end 13 of the heat exchange passage 11. The lubricating oil cooled in the heat exchange passage 11 and flowing out from the outlet end 14 of the heat exchange passage 11 is introduced into the jacket 65 via the third passage 59. After lubricating the valve actuating mechanism incorporated in the cylinder head 1*a*, the lubricating oil is ultimately received by the belt chamber 27. In the jacket 65, the lubricating oil flows centrally through a groove 62 defined between the two longitudinal ribs 69, and passes into the passage 60 to lubricate the valve actuating mechanism by way of the passage 63 defined in the camshaft 23. The part of the lubricating oil which has flowed over the notches 71 of the longitudinal ribs 69 is introduced into lower parts of the jacket 65, and passes into the belt chamber 27 from the openings 68 defined in the lowest parts of the jacket 65.

FIGS. 12 through 16 show a third embodiment of the present invention. In this embodiment also, those parts corresponding to the parts of the preceding embodiments are denoted with like numerals.

This embodiment is similar to the embodiment illustrated in FIGS. 7 through 11, but differs from that embodiment in the structure of its cooling liquid jacket.

Figure 16:
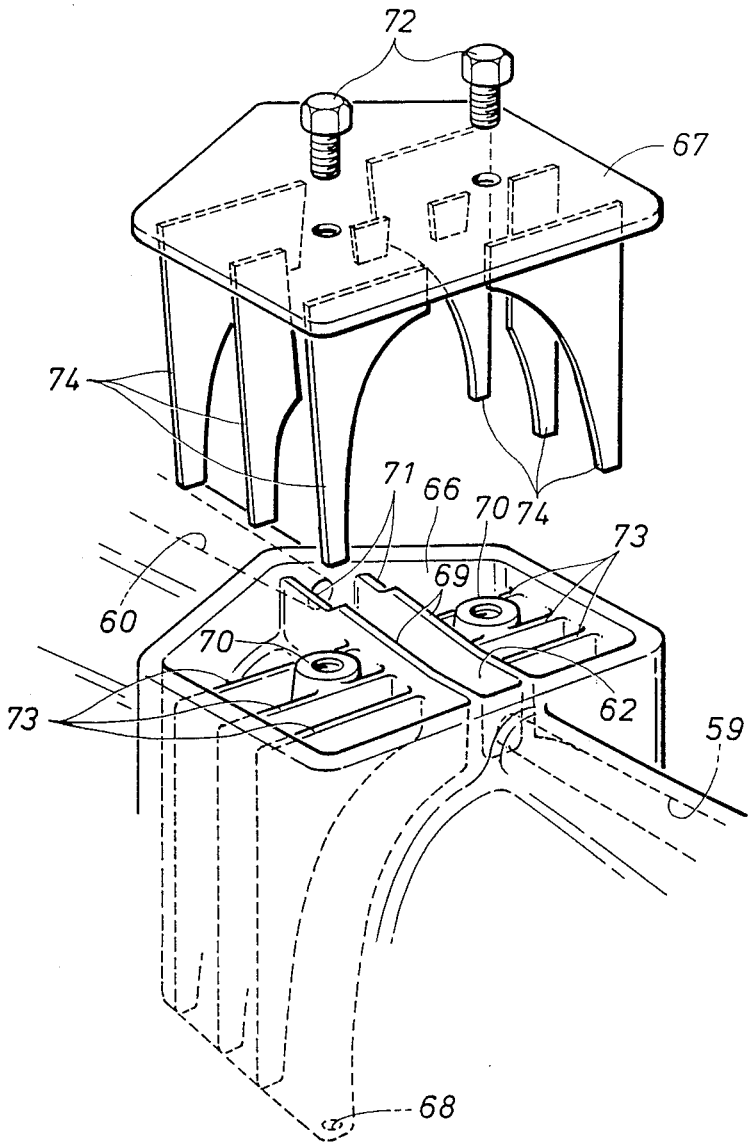
FIG. 16 is an exploded perspective view of a part of the third embodiment.

As best shown in FIG. 16, the bottom surface of this cooling liquid jacket 65 extending along the upper side of the cylinder bore 7 is provided with a pair of longitudinal ribs 69 defining a groove 62 communicating the passage 59 with the passage 60 which leads to the valve actuating mechanism. The ribs 69 are provided with notches 71 for allowing lubricating oil to flow over the upper edges of the longitudinal ribs 69 into the lower parts of the cooling liquid jacket 65. The lowest parts of the cooling liquid jacket 65 on either side of the cylinder bore 7 are provided with openings 68 communicating with the belt chamber 27 in a manner similar to the previous embodiment.

According to this embodiment, however, three lateral ribs 73 extend from the outer side surface of each of the longitudinal ribs 69 to the associated inner wall surface of the cooling liquid jacket 65. One of the three ribs 73 is integrally connected to a boss 70 defining a threaded hole for receiving a threaded bolt securing a cover plate 67 upon an open end 66 of this cooling liquid jacket 65. The lower side or the inner side of the cover plate 67 is provided with a plurality of lateral ribs 74 so as to interdigitate with the corresponding lateral ribs 73 without interfering with the longitudinal ribs 69 or the bosses 70.

Thus, the lateral ribs 73 and 74 provided in the bottom the jacket 65 and the cover plate 65 define a tortuous passage inside the jacket 65, and a favorable heat conduction between the cylinder block and the cooling liquid can be achieved.

What we claim is:

1. A liquid cooled internal combustion engine, comprising:

an integrally cast engine main body including a cylinder block defining a cylinder bore extending laterally therein, a cylinder head disposed at a longitudinal end of said cylinder block, and a skirt extending from the other longitudinal end of said cylinder block;

a crankcase cover attached to an open end of said skirt to define a crankcase therein;

a crankshaft extending vertically in said crankcase and rotatably supported by said skirt at its both ends;

a piston slidably received in said cylinder bore to define a combustion chamber in cooperation with said cylinder head and said cylinder bore and coupled to a crank pin of said crankshaft via a connecting rod;

a camshaft rotatably supported by said cylinder head and extending in parallel with said crankshaft;

a timing belt passed around pulleys mounted on lower ends of said camshaft and said crankshaft, respectively, and extending in a belt chamber defined in said cylinder block along a lower side of said cylinder bore;

a cooling liquid jacket defined in said cylinder block along upper and lateral sides of said cylinder bore; and cooling liquid supply means for circulating cooling liquid in said jacket and removing heat from said cooling liquid.

2. A liquid cooled internal combustion engine according to claim 1, wherein said jacket is defined by a cavity formed by a core pulled towards the open end of said skirt during a casting process, and a cover plate closing an open end of said cavity.

3. A liquid cooled internal combustion engine according to claim 2, wherein a bottom surface of a part of said jacket is provided with at least one longitudinal rib extending along an upper side of said cylinder bore.

4. A liquid cooled internal combustion engine according to claim 1, wherein said jacket is defined by a cavity formed by a core pulled upwards from an upper side of said cylinder block during a casting process, and a cover plate closing an open end of said cavity.

5. A liquid cooled internal combustion engine according to claim 4, wherein a bottom surface of a part of said jacket is provided with at least one longitudinal rib extending along an upper side of said cylinder bore.

6. A liquid cooled internal combustion engine according to claim 4, wherein a bottom surface of a part of said jacket is provided with at least one lateral rib extending along an upper side of said cylinder bore.

7. A liquid cooled internal combustion engine according to claim 6, wherein a bottom surface of a part of said jacket is provided with a plurality of lateral ribs extending along an upper side of said cylinder bore, and said cover plate is provided with a plurality of lateral ribs on its inner surface so as to interdigitate with said lateral ribs on said bottom surface of said jacket.

8. A liquid cooled internal combustion engine according to claim 1, wherein said cooling liquid consists of lubricating oil for lubricating said internal combustion engine, and said cooling liquid supply means comprises an oil pump disposed in a lower part of said cylinder block near a lower end of said crankshaft to draw lubricating oil from a bottom area of said belt chamber, an oil supply passage extending from an outlet end of said oil pump to said jacket through a bore defined in said crankshaft, and an oil return passage extending from said jacket to said belt chamber via a valve mechanism incorporated in said cylinder head.

9. A liquid cooled internal combustion engine according to claim 8, wherein an upper end of said crankshaft coaxially carries a disk member which internally defines a heat exchange passage interposed between said bore in said crankshaft and said jacket as a part of said oil supply passage.

10. A liquid cooled internal combustion engine according to claim 9, further comprising a balancer shaft rotatably supported by said skirt in parallel with said crankshaft, and power transmitting means for transmitting rotative power from said crankshaft to said balancer shaft, said oil pump being driven by a lower end of said balancer shaft.

11. A liquid cooled internal combustion engine according to claim 8, wherein a pair of longitudinal ribs are provided on a part of a bottom surface of said jacket extending along an upper side of said cylinder bore defining a longitudinal groove communicating an outlet end of said bore of said crankshaft with an upper end of said camshaft in said cylinder head, and an opening is provided in a low part of said jacket to conduct a part of said lubricating oil which has flowed over upper edges of said longitudinal ribs directly into said belt chamber.

* * * * *